US009382637B2

(12) United States Patent
Balague

(10) Patent No.: US 9,382,637 B2
(45) Date of Patent: Jul. 5, 2016

(54) METHOD OF ANODIZING HOLLOW METALLIC BODIES

(71) Applicant: Josep Valls Balague, Barcelona (ES)

(72) Inventor: Josep Valls Balague, Barcelona (ES)

(73) Assignee: THOMAS GMBH, Langenselbold (DE)

( * ) Notice: Subject to any disclaimer, the term of this patent is extended or adjusted under 35 U.S.C. 154(b) by 0 days.

(21) Appl. No.: 13/938,328

(22) Filed: Jul. 10, 2013

(65) Prior Publication Data

US 2014/0014523 A1 Jan. 16, 2014

(30) Foreign Application Priority Data

Jul. 12, 2012 (EP) ..... 12176185

(51) Int. Cl.
*C25D 7/04* (2006.01)
*C25D 11/02* (2006.01)
*C25D 11/00* (2006.01)

(52) U.S. Cl.
CPC ..... *C25D 7/04* (2013.01); *C25D 11/005* (2013.01); *C25D 11/02* (2013.01)

(58) Field of Classification Search
CPC ..... C25D 17/12; C25D 7/04; C25B 15/02; C25B 15/08; C25B 1/10; C25B 1/26; C25B 1/13; C25B 1/16; C25B 9/00; C25B 9/04; C25B 9/206; C25B 11/0494
USPC ..... 205/145; 204/201, 227
See application file for complete search history.

(56) References Cited

U.S. PATENT DOCUMENTS 1,382,144 A * 6/1921 Taylor ..... 134/66
3,391,073 A * 7/1968 Rusch et al. ..... 204/202
5,858,098 A * 1/1999 Boger et al. ..... 118/423
8,293,077 B2 10/2012 Vacheron

FOREIGN PATENT DOCUMENTS

DE 1274979 A 8/1968
GB 1 428 856 * 3/1976 ..... C25D 17/08

OTHER PUBLICATIONS

Wayback capture for "http://dictionary.reference.com/browse/inverted" from Dec. 1, 2006.*

* cited by examiner

*Primary Examiner* — James Lin
*Assistant Examiner* — Leo Ahnn
(74) *Attorney, Agent, or Firm* — Andrew Wilford

(57) ABSTRACT

A plurality of cup-shaped workpieces are anodized by first securing each of them in a downwardly open position on an electrically conductive and flat workpiece frame that is then inverted such that the workpieces are open upward and lowered into a body of anodizing liquid in a treatment bath until the workpieces are wholly immersed and the frame is in contact with a horizontal rail. Thereafter the frame is moved horizontally while wholly immersed in the anodizing liquid while electricity flows between the rail and a cathode immersed in the bath below the workpieces such the liquid anodizes surfaces of the workpieces. The frame is raised out of the body of liquid with the workpieces open upward, and, while the workpieces are still above the body of liquid, inverting the frame and the workpieces so that the workpieces are open downward and any treatment liquid drains downward into the bath.

10 Claims, 4 Drawing Sheets

8
1
15
20
20
17
18
11
15
20
20

METHOD OF ANODIZING HOLLOW METALLIC BODIES

FIELD OF THE INVENTION

The present invention relates to a method of anodizing hollow metallic bodies. More particularly this invention concerns anodizing metal cup-shaped bodies.

BACKGROUND OF THE INVENTION

For anodizing, metallic hollow bodies or workpieces are secured on projecting fingers of electrically conductive workpiece holders, and the workpiece holders are transferred in steps in a predefined work cycle through a series of treatment baths including at least one anodizing bath in which anodic oxidation on the surfaces of the cup-shaped workpieces is effected by a closed electric circuit between the workpiece holder and a cathode in the treatment bath.

Anodizing or anodic oxidation is an electrochemical process that converts the metal surface of a workpiece into a metal oxide. The resulting oxide layer is intimately bonded to the metallic base material. The layer thickness can be set in a defined manner by the selection of appropriate process parameters. Anodizing is primarily used for surface finishing workpieces of aluminum or aluminum alloys. The anodized layer durably protects the aluminum from environmental influences, is easy to clean and, through the structure of the oxide layer, allows decorative coloration. This method is used in practice to provide cup-shaped workpieces such as sleeves caps with a high-quality decorative surface.

In addition to an anodizing bath, the treatment baths comprise further baths in which the workpieces are degreased, chemically treated, rinsed and sealed. The color effect and the gloss effect can be achieved and influenced by different immersion times in the different treatment liquids.

In a well known method, the workpiece holders that were previously loaded with the workpieces to be treated are oriented pointing downward from a conveyor, and the workpiece are transported upright and are vertically dipped into the treatment liquid of the treatment baths. In this method, workpieces at the lower end of the workpiece holder are in the treatment liquid for a longer time than the workpieces at the upper end of the workpiece holder. The different dwell time in the anodizing bath and in a downstream coloring bath has a negative effect on the quality of the workpiece surfaces. The anodized and colored surfaces of the workpieces differ, for example, with regard to color intensity that greatly depends on the dwell time of the workpieces in the coloring bath.

Moreover, the orientation of the workpieces results in quality differences between the anodized surfaces on the upper region and lower region of the hollow body. Another disadvantage of the known method is that after pulling the vertically oriented workpiece holder out of the treatment bath, the treatment liquid does not completely flow off the workpieces within the limited time determined by the work cycle. This results in significant carryover losses of the treatment liquid during movement of the workpiece holder from bath to bath. This has a negative effect, among other things, on the sewage disposal and the consumption of chemicals.

In a method known from U.S. 2008/0257717 (U.S. Pat. No. 8,293,077), the workpiece holders that were previously loaded with the cup-shaped workpieces to be treated are transferred to a drum that rotates in steps in the treatment bath. Here, the workpiece holders move through the treatment bath on a helical path. Depending on the needed dwell time, the drum performs one or more full revolutions. A plurality of treatment baths that are equipped with a suitable device are in a row one behind the other such that the workpiece holders with the workpieces to be treated can be guided through a plurality of different treatment baths. The dwell time in the treatment baths depends on the number of revolutions of the drum and can be varied only in steps having a time that is equal to a whole-number multiple of the time of a full revolution. It is difficult to set a very short treatment time and to combine it with baths that require a very long dwell time. If the drum needs a plurality of revolutions for setting a long dwell time, it is also disadvantageous that during the treatment in the treatment liquid, the workpieces leave the treatment liquid again and again and dip again into the treatment liquid. The method-related limitations have a negative effect on the surface quality of the workpieces.

In a method of anodizing cup-shaped workpieces known from DE 12 74 979, the workpieces are fixed on an endless titanium or zirconium belt that forms loops and is guided through a row of treatment baths. The dwell time of the workpieces can be varied by the number of belt loops within a treatment bath. In this method too, a significant carryover of the treatment liquid from treatment bath to treatment bath is unavoidable.

OBJECTS OF THE INVENTION

It is therefore an object of the present invention to provide an improved method of anodizing hollow metallic bodies.

Another object is the provision of such an improved method of anodizing hollow metallic bodies that overcomes the above-given disadvantages, in particular that is characterized by a low carryover of treatment liquids from treatment bath to treatment bath, and by means of which it is possible to produce workpieces with a surface of high quality that is finished by anodizing and is in particular colored.

In particular, all the workpieces fixed on a workpiece holder must be given an identical surface finish with regard to color intensity and gloss and, in particular, quality differences between upper and lower regions of the anodized cup-shaped workpieces must also be avoided.

SUMMARY OF THE INVENTION

Surfaces of metallic hollow workpieces are anodized by first securing a plurality of the hollow workpieces to respective fingers of an electrically conductive workpiece holder. The workpiece holders are then horizontally in steps in a travel direction along a row of upwardly open treatment baths of which at least one holds an anodizing treatment liquid. The workpieces and the holder are lowered into an upstream end of the one bath while flowing electricity between the holder and the treatment liquid so as to anodize surfaces of the workpieces. Then the workpieces and the holder are raised at a downstream end of the one bath and generally simultaneously the holder and workpieces are inverted such that the treatment liquid runs down off the workpieces into the one bath.

Thus with this invention, the workpiece holders are lowered in a transfer station at the upstream ends of the treatment baths into the treatment bath and are fed horizontally within the treatment bath in one or a plurality of steps predefined by the work cycle to an unloading station of the treatment bath. In a subsequent work cycle, the workpiece holders are lifted at the downstream ends of the baths in the unloading station and are turned by 180° so that liquid drips off the cup-shaped workpieces and down into the treatment bath. In the anodizing bath, the workpiece holders are moved on a metal rail that is connected to the anode of the electric circuit.

In the method according to the invention, the workpiece holders in the treatment liquid of the treatment baths are always moved horizontally. The projecting fingers of the workpiece holders on which the workpieces are secured extend downward in the treatment bath so that the treatment liquid can also flow into the interior of the cup-shaped workpieces without being blocked by gas bubbles.

With the method according to the invention, each workpiece has the same dwell time in the treatment liquid. This way, a particularly uniform treatment result is achieved. Workpieces colored after anodizing using the dipping method receive a uniform color intensity, and, moreover, no differences occur between the inside and the outside of the hollow body.

The workpiece holders are moved horizontally through the treatment baths on a conductive rail system in steps that are predetermined by the work cycle of the process. The immersion time required in the process fluids is defined by the number of steps and the duration of the steps. In the unloading station of the treatment baths, the workpiece holders are lifted and turned by 180°. Due to the overhead position of the workpiece holders, the treatment liquid can drip off almost completely from the interior of the cup-shaped workpieces and also from the outer surfaces of the workpieces into the treatment bath. Vertical alignment of the workpieces on the workpiece holders in connection with a 180° rotation of the workpieces when removing them from the treatment bath ensures low transfer treatment liquids from treatment bath to treatment bath. This way, the consumption of chemicals and energy, for example for pumps and for heating the treatment liquid, decreases. Disposal costs can also be reduced.

In the method according to the invention, a plurality of workpiece holders moved in a row is transferred simultaneously through a treatment bath. Thus at the same time one workpiece holder in the transfer station of the treatment bath is lowered into the treatment bath, one workpiece holder in the unloading station is removed from the treatment bath, and at least one further workpiece holder is moved through the treatment bath.

According to a preferred embodiment of the invention, the workpiece holders are inverted by rotation in the transfer station of at least one treatment bath and while doing this are lowered from a first position above the bath liquid of the treatment bath into a second position within the liquid. The inverter is configured and arranged such that rotation of the workpiece holders alone effects the required lifting movement as well as the inversion movement by 180°, which is essential for the method according to the invention, is carried out. The unloading station of the treatment bath can be equipped with a structurally identical inverter that lifts the workpiece holders out of the treatment bath by rotation through 180°.

In a further configuration of the method according to the invention the workpiece holders are inverted in the transfer station of at least one treatment bath by rotation, and subsequent to inversion, are lowered by a straight-line vertical movement from a position above the treatment bath into the bath liquid. In so doing, the workpieces perform a straight-line as well as a rotational movement. This configuration has the advantage that all workpieces fixed on the workpiece holders reach the liquid level of the treatment bath at the same time and dip into the treatment liquid of the treatment bath. The embodiment described is in particular suitable for treatment baths in which the dwell time has to be set with very high accuracy and that require that all cup-shaped workpieces fixed on the workpiece holder have the same dwell time. The described embodiment of the transfer station is preferably used for coloring baths in which workpieces having tight tolerances need a defined dwell time between 15 and 30 sec, and in which deviations from the specified value affect the color intensity.

Within the treatment baths, the workpiece holder lie on a rail and are preferably moved by the straight-line movements of a pusher. The anode of the electrical circuit associated with the anodizing bath is connected to the rail that bridges a space between the transfer station and the unloading station of the treatment bath. Thus, the rail is connected to the positive terminal of a DC voltage source, a contact point between the anode and the rail lying in the bath liquid. This ensures good electrical transmission. Electrical contacting within the treatment liquid is more effective and less susceptible to fault than contacting outside of the bath.

The cathode for the anodizing process is advantageously below the rail that is electrically connected to the anode. Preferably, the cathode is at the bottom of the anodizing bath, while the rail is wholly above the body of treatment liquid.

Since the workpiece holders are horizontally lowered into the treatment baths and are horizontally transferred through the treatment baths, shallow treatment baths with a low liquid level can be used. Compared with the prior art, the method according to the invention can operate with smaller amounts of liquid. This has energy-related advantages with regard to heating and controlling the temperature of the baths. Furthermore, there are fewer problems when replacing the baths, and the method according to the invention can be operated economically even for small lot sizes of the workpieces to be anodized.

For the method according to the invention, workpiece holders are used that comprise a base frame and bars fastened to the base frame and having a plurality of elastically deformable fingers arranged in pairs for securing the cup-shaped workpieces. The base frame of the workpiece holders can be guided on opposite sides in C-section rails. During overhead movement in the transfer station and unloading station of the treatment baths, no additional fixations between the rail elements and the workpiece holder are needed. The C-section rails can be produced from wire elements so that the treatment liquid can easily flow around them, and no liquid accumulation occurs in the rail system when changing the bath liquid.

BRIEF DESCRIPTION OF THE DRAWING

The above and other objects, features, and advantages will become more readily apparent from the following description, reference being made to the accompanying drawing in which.

DETAILED DESCRIPTION OF THE INVENTION

Figure 1:
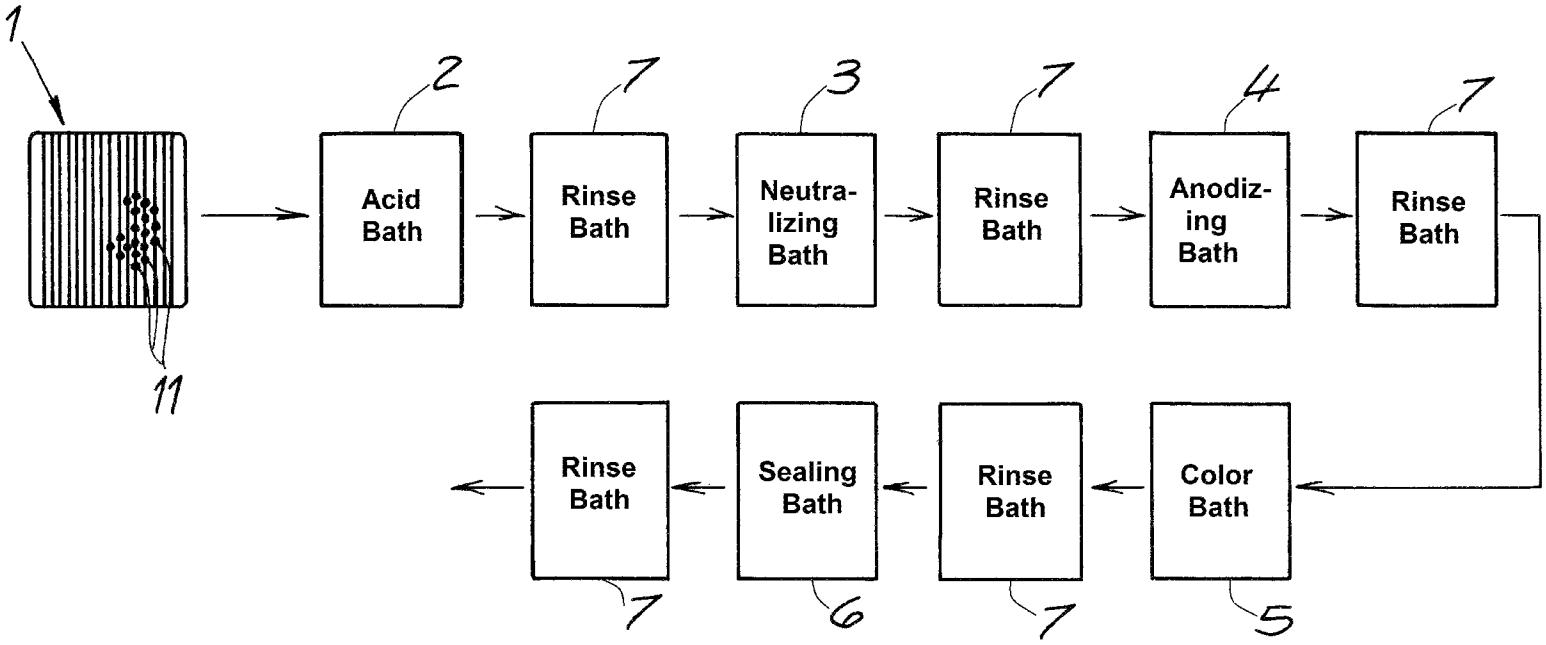
FIG. 1 is a schematic diagram illustrating the method of this invention.

As seen in FIG. 1 hollow cup-shaped workpieces 11 (FIGS. 2-4) are secured on projecting fingers of electrically conductive workpiece holders 1, and the workpiece holders 1 are transferred step by step in a predefined work cycle through a series of treatment baths. The treatment baths comprise in particular an acid etching bath 2, a bath 3 for neutralizing the workpieces, an anodizing bath 4, a bath 5 for coloring, and a bath 6 for sealing the treated workpiece surface. Between these treatment baths 2 to 6, the workpieces are rinsed by immersion in rinse baths 7.

Figure 2:
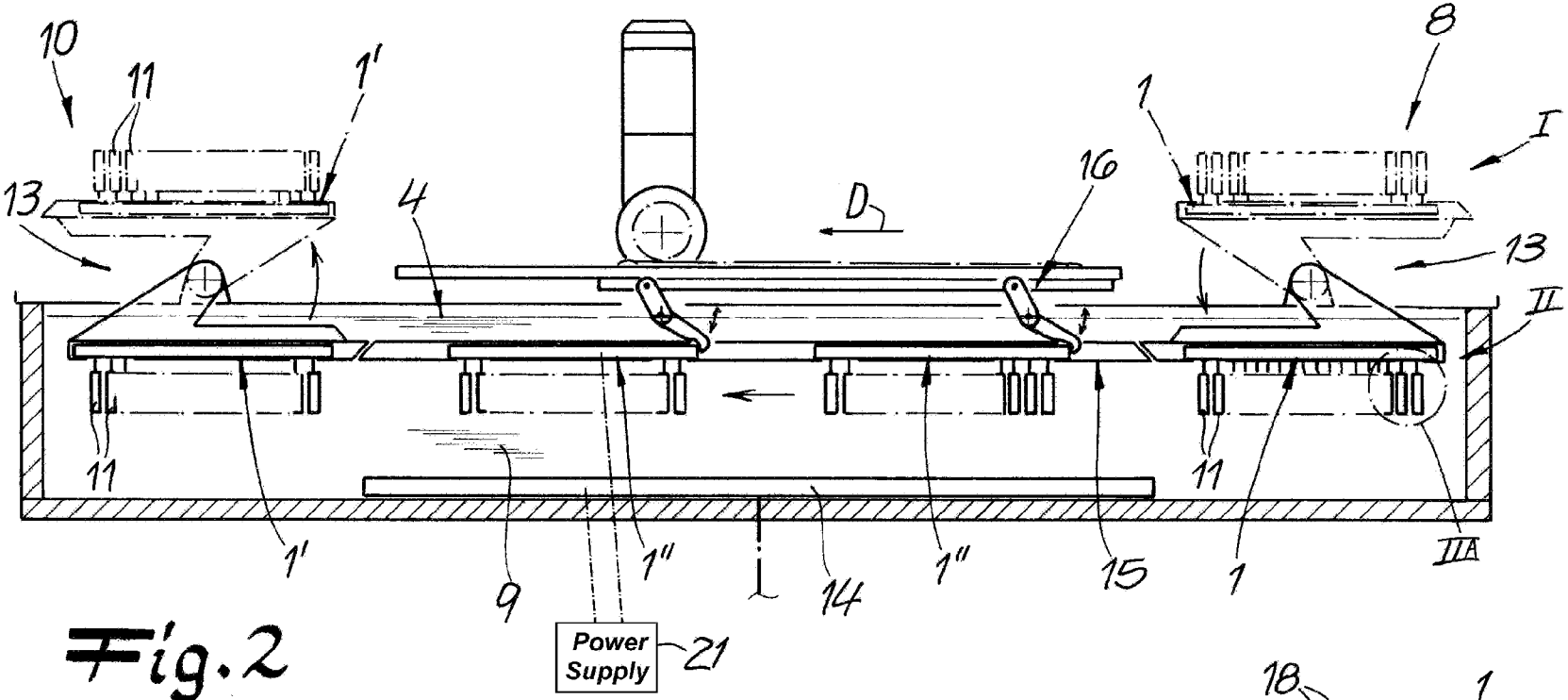
FIG. 2 is a side view of a treatment bath for the method shown in FIG. 1.

One of the treatment baths, for example, the anodizing bath 4 is schematically shown in FIG. 2. In a transfer station 8 of the treatment bath, the workpiece holders 1 are lowered into the treatment bath and are fed horizontally in a travel direction D in the body 9 of treatment liquid of the bath in one or a plurality of steps predefined by the work cycle to an unloading station 10 of the treatment bath. In a subsequent work cycle, the workpiece holder 1' positioned in the unloading station is lifted and pivoted through 180° so that liquid drips down from the cup-shaped workpieces 11 into the treatment bath. FIG. 2 also shows that a plurality of workpiece holders 1, 1', 1" are transferred simultaneously through the treatment bath. One workpiece holder 1 in the transfer station 8 of the treatment bath is lowered into the treatment bath, one workpiece holder 1' in the unloading station 10 is removed at the same time from the treatment bath, and at least one further workpiece holder 1" is moved through the treatment bath.

In the transfer station 8 of the treatment bath, the workpiece holders 1 are inverted by rotation through 180° and, at the same time, are lowered from a first position I above the body 9 of liquid of the treatment bath into a second position II within the bath liquid. In the second position II, the fingers 12 of the workpiece holder 1 extend vertically downward so that the hollow workpieces 11 that are fixed on the fingers by clamping are upwardly and the treatment liquid can also flow into the hollow workpieces 11 without being blocked by gas bubbles. When outside the treatment bath, the projecting fingers 12 of the workpiece holders 1 extend upward so that the hollow workpieces 11 are fixed on the fingers open downward, in an overhead position, and any liquid can drip unhindered from inside these cup-shaped workpieces 11.

The unloading station 10 of the treatment bath has a structurally identical inverter 13. Rotation by the inverter 13 lifts the workpiece holder 1' to a level above the liquid level of the treatment bath and, at the same time, also rotates it through 180°. This is described in copending application based on EP 12 176 197.7.

The method according to the invention is characterized by a low carryover of treatment liquid from treatment bath to treatment bath. Furthermore, the dwell time of the workpieces 11 fixed on a workpiece holder within the treatment liquid is consistent. This way, a very uniform treatment result is achieved. The treatment baths for the schematic plant shown in FIG. 1 preferably have this described structure and differ only with respect to length. The required immersion times in the treatment liquids are achieved through the work cycle and the length of the treatment bath.

In the anodizing bath 4, anodic oxidation on the surfaces of the hollow workpieces 11 is effected by a closed electric circuit from a power supply 21 between the workpiece holder 1" and a cathode 14 in the treatment bath. This process converts the metallic surfaces of the workpieces 11 of aluminum or an aluminum alloy into aluminum oxide. The workpieces 1, 1', 1" are preferably made of titanium and are not affected by the anodic oxidation. Within the anodizing bath 4, the workpiece holders 1, 1', 1" are supported on a rail 15 and are moved by straight-line movement of a pusher 16. The anode of the power supply 21 associated with the anodizing bath 4 is connected to the rail 15 that bridges the space between the transfer station 8 and the unloading station 10. The contact point between the anode and the rail 15 is in the bath liquid. The cathode 14, which is also connected to the power supply 21, is below the rail 15 that is electrically connected to the anode, and is preferably at the bottom of the treatment bath, submerged in the conductive liquid of the body 9 of treatment liquid.

Figure 2A:
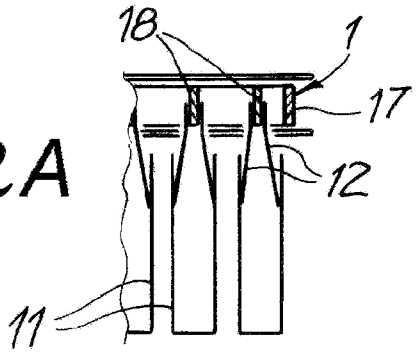
FIG. 2A is a large-scale view of the detail indicated at IIA in FIG. 2.
Figure 3:
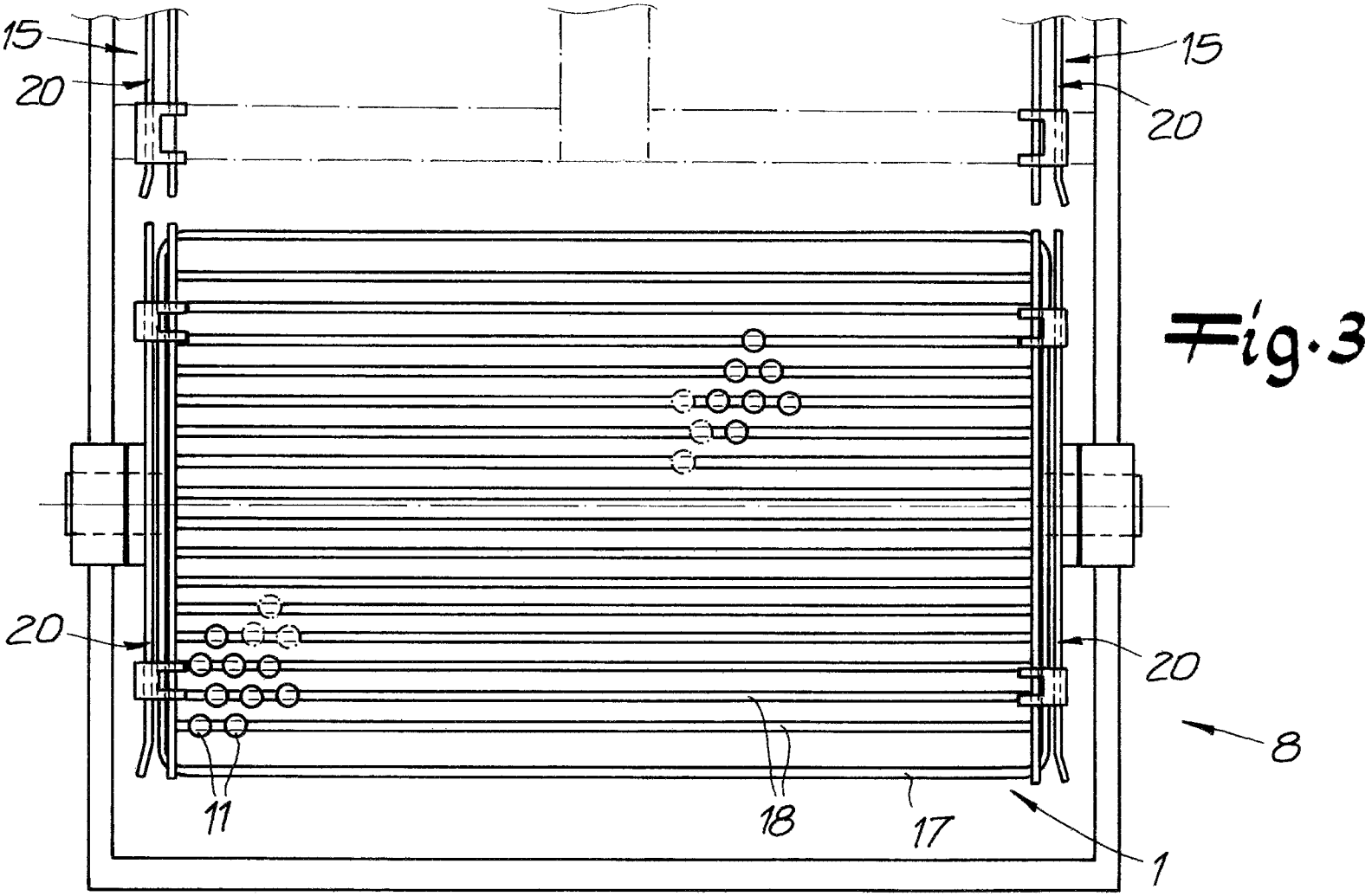
FIG. 3 is a top view of a transfer station for the treatment bath shown in FIG. 2.

Comparison of FIGS. 2, 2A, and 3 shows that the workpiece holders 1, 1', 1" comprise a flat base frame 17 and bars 18 that are fastened to the base frame 17 and have a plurality of elastically deformable fingers 12 arranged in pairs for fixing the hollow workpieces 11. The base frame 17 of the workpiece holder 1 is guided on opposing sides in C-section rails 20 and is held during overhead movements in the transfer station 8 and the unloading station 10 of the treatment bath by rails 20 which also are of C-section. The rails 20 are made of metal wires and form no cavities that could trap the treatment liquid.

Figure 4:
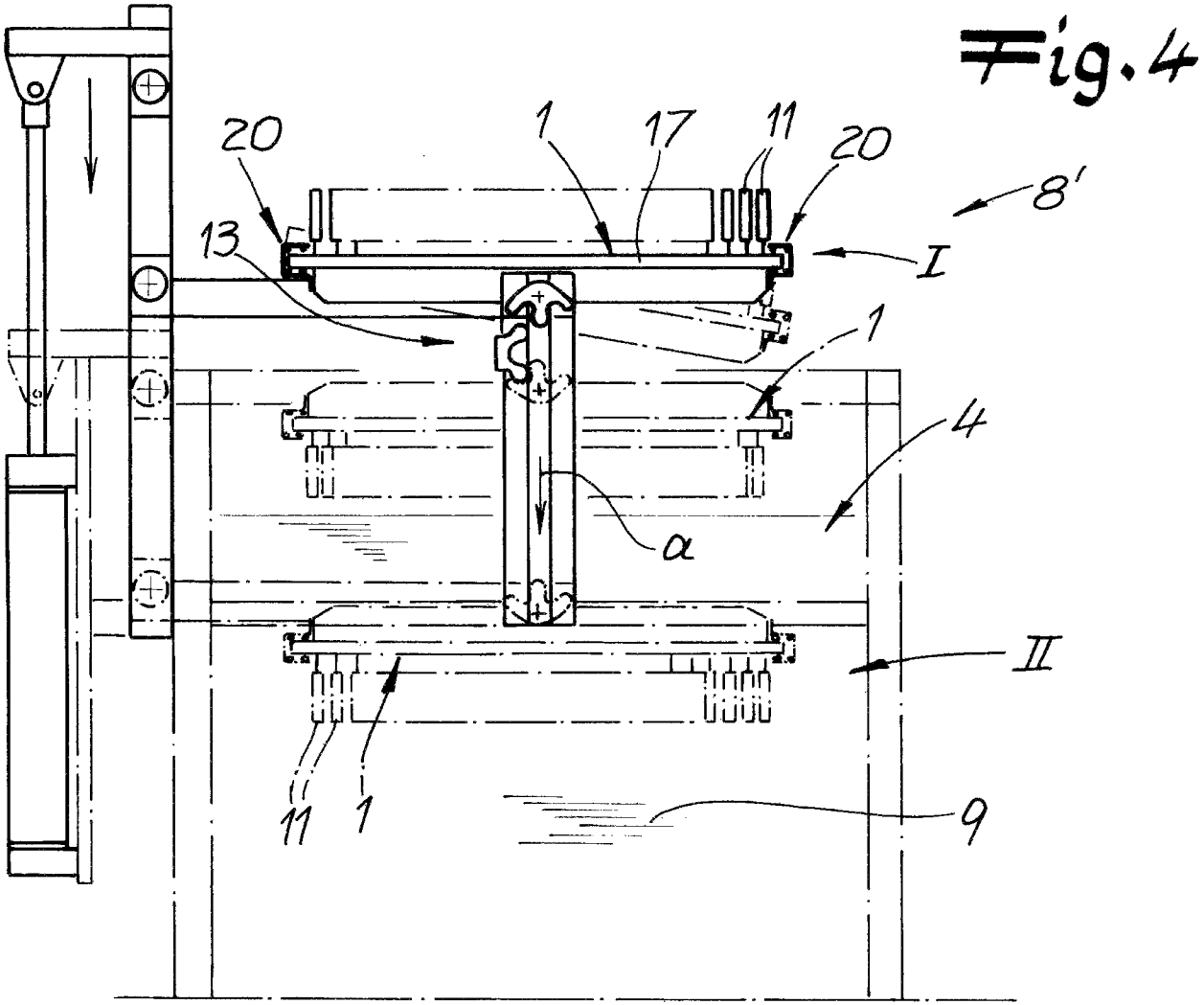
FIG. 4 shows an alternative configuration of a transfer station for the treatment bath shown in FIG. 2.

FIG. 4 shows a variant of the transfer station. In the transfer station 8' shown in FIG. 4, the workpiece holders are rotated and after such pivoting, they are lowered from a position above the treatment bath into the bath liquid by vertical straight-line movement. The movement is composed of a rotation of 180° and straight-line movement a. The transfer station 8' shown in FIG. 4 has the advantage that all the hollow workpieces 11 fixed on the holder dip into the treatment liquid at the same time by this straight-line lowering movement. The transfer station 8' shown in FIG. 4 is preferably used for treatment baths in which all the workpieces 11 fixed on a workpiece holder 1 require the same dwell time within tight tolerances. The transfer station shown in FIG. 4 is therefore in particular used for coloring baths in which the previously anodized workpieces 11 are colored by immersion. The dwell time in the coloring bath is short and has to be precisely set for generating consistent color intensities.

I claim:

1. A method of anodizing surfaces of metallic hollow workpieces, the method comprising the steps of:

securing a plurality of the hollow workpieces to respective pairs of electrically conductive and elastically deformable fingers carried on bars of an electrically conductive and flat workpiece base frame;

conveying the workpiece frame in a horizontal travel direction in steps in a travel direction along a row of upwardly open treatment baths of which at least one holds an anodizing treatment liquid such that the frame passes from an upstream station at an upstream end of the one bath to a downstream station at a downstream end of the one bath, the one bath holding an electrically conductive rail extending between the stations and submerged in the bath of anodizing treatment liquid, an anode of a power supply being connected to the rail at a point submerged in the bath of anodizing treatment liquid;

when the frame is in the upstream station, inverting the frame and workpieces by a rotation of 180° and thereby inverting the workpieces on the fingers and thereafter while still in the upstream station lowering the inverted frame with the inverted workpieces into the upstream end of the one bath into engagement with the rail such that the inverted workpieces are immersed in the one bath;

supporting the inverted workpieces and the inverted frame on the rail while displacing the inverted and submerged workpieces and the inverted frame from the upstream end to the downstream end and while flowing electricity from the power supply through the rail, the frame, and the workpieces so as to anodize surfaces of the workpieces;

when the frame is in the downstream station, raising the inverted workpieces and the inverted frame and again inverting the frame and workpieces through 180° such that when the workpieces are above the one bath the treatment liquid runs down off the workpieces and into the one bath; and thereafter transporting the frame and workpieces downstream out of the downstream station.

2. The method defined in claim 1, further comprising the step of:

providing a cathode in the bath below the workpieces and flowing the electricity between the rail and the cathode through the frame, the workpieces, and the one bath.

3. The method defined in claim 1 wherein a row of such frames each having on each of the respective bars a plurality of the pairs of the fingers carrying respective workpieces moves in the direction along and through the baths such that at the same time:

one workpiece frame at the upstream end of the treatment bath is lowered into the one treatment bath, one workpiece frame at the downstream end of the one treatment bath is raised up out of the one treatment bath, and at least one further workpiece frame is moved horizontally through the one treatment bath between the ends thereof.

4. The method defined in claim 1, wherein the workpieces are cup-shaped and are oriented open downward prior to inversion and lowering into the one bath, are oriented open upward while lowered in the upstream station into the bath, and are again oriented open downward when inverted after being raised in the downstream station out of the bath and inverted.

5. The method defined in claim 1, wherein the frame and workpieces is moved in a vertical straight-line movement when being lowered into and raised out of the bath in the upstream and downstream stations.

6. The method defined in claim 1, wherein the frame is rigid and lies in a horizontal plane while being moved from the upstream end to the downstream end of the one bath.

7. The method defined in claim 1, wherein there are two such rails in the one bath, the rails are of C-section open toward each other, and the frame is gripped and fits between the rails when moving horizontally in the one bath.

8. The method defined in claim 7, further comprising:

holding the frame during inversion in the upstream station between two C-section rails open toward each other.

9. The method defined in claim 8, wherein the C-section rails are constructed of metal wires so as to drain and trap none of the treatment liquid.

10. A method of anodizing a plurality of cup-shaped workpieces, the method comprising the steps of:

securing each of the workpieces in a downwardly open position on respective elastically deformable and electrically conductive fingers extending downward from bars of an electrically conductive and flat base frame;

inverting the frame by rotation through 180° such that the workpieces are open upward and lowering the frame and the upwardly open workpieces into a body of anodizing liquid in a treatment bath until the workpieces are wholly immersed, an electrically conductive rail being submerged in the bath of anodizing treatment liquid;

moving the frame and the workpieces with the workpieces wholly immersed in the body of anodizing liquid horizontally along and in electrical contact with the rail while passing electricity between the rail and a cathode immersed in the bath below the workpieces such that the electricity flows through the workpieces and the liquid anodizes surfaces of the workpieces;

raising the frame out of the body of liquid and inverting the frame and the workpieces through 180° so that after the workpieces are above the body of liquid the workpieces are open downward and any treatment liquid trapped in the workpieces drains downward back into the bath.

* * * * *